US009931632B2

(12) United States Patent
Irmscher

(10) Patent No.: US 9,931,632 B2
(45) Date of Patent: Apr. 3, 2018

(54) DISPERSION AND ACCUMULATION OF MAGNETIC PARTICLES IN A MICROFLUIDIC SYSTEM

(71) Applicant: KONINKLIJKE PHILIPS N.V., Eindhoven (NL)

(72) Inventor: Matthias Irmscher, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/322,554

(22) PCT Filed: Dec. 1, 2015

(86) PCT No.: PCT/EP2015/078118

§ 371 (c)(1),
(2) Date: Dec. 28, 2016

(87) PCT Pub. No.: WO2016/087397

PCT Pub. Date: Jun. 9, 2016

(65) Prior Publication Data

US 2017/0259264 A1 Sep. 14, 2017

Related U.S. Application Data

(60) Provisional application No. 62/102,757, filed on Jan. 13, 2015.

(30) Foreign Application Priority Data

Dec. 2, 2014 (EP) ..... 14195888

(51) Int. Cl.
*B01L 3/00* (2006.01)

(52) U.S. Cl.
CPC ..... *B01L 3/502761* (2013.01); *B01L 3/50273* (2013.01); *B01L 3/502715* (2013.01);
(Continued)

(58) Field of Classification Search
CPC ..... B01L 3/502761; B01L 3/50273; B01L 3/502784; B01L 3/502715;
(Continued)

(56) References Cited

U.S. PATENT DOCUMENTS

2002/0098097 A1 7/2002 Singh
2012/0295366 A1 11/2012 Zilch
2014/0370511 A1 12/2014 Katasho

FOREIGN PATENT DOCUMENTS

WO 2008147530 A1 12/2008
WO 2009108260 A2 9/2009
(Continued)

OTHER PUBLICATIONS

The International Preliminary Report on Patentability for PCT/EP2015/078118, dated Jun. 2017.*
(Continued)

*Primary Examiner* — David A Reifsnyder

(57) ABSTRACT

A microfluidic system includes a magnetic source (150) and two chambers (110) that are connected by a channel. The chambers and the channel are filled with different fluids such that a non-zero surface tension is created at the associated fluidic interfaces. Moreover, the magnetic source (150) is arranged to provide at least two separate magnetic gradient regions (GR) and to allow for the attraction of magnetic particles (MP) present in one of the chambers into these different regions. The magnetic forces (F) generated by at least one of the gradient regions (GR) is strong enough to allow for pushing or pulling magnetic particles through the fluidic interfaces. The magnetic source may be realized by a permanent magnet (150) of hexahedral shape. A method achieves dispersion and re-accumulation of an ensemble of magnetic particles in the microfluidic system.

13 Claims, 2 Drawing Sheets

(52) U.S. Cl.
CPC ... *B01L 3/502784* (2013.01); *B01L 2200/027* (2013.01); *B01L 2200/0647* (2013.01); *B01L 2200/0673* (2013.01); *B01L 2300/0864* (2013.01); *B01L 2400/043* (2013.01)

(58) Field of Classification Search
CPC ..... B01L 2300/0864; B01L 2200/027; B01L 2200/0647; B01L 2200/0673; B01L 2400/043
See application file for complete search history.

(56) References Cited

FOREIGN PATENT DOCUMENTS

| | | | | |
|---|---|---|---|---|
| WO | 2009132151 | A2 | 10/2009 | |
| WO | 2010070461 | A1 | 6/2010 | |
| WO | 2011042828 | A1 | 4/2011 | |
| WO | WO 2016087397 | A1 * | 6/2016 | ..... B01L 3/50273 |

OTHER PUBLICATIONS

Den Dulk, Remco C. et al "Magneto-Capillary Valve for Integrated Purification and Enrichment of Nucleic Acids and Proteins", Lab Chip, vol. 13, No. 106, 2013.
Den Dulk, Remco C. et al "Magneto-capillary valve for integrated biological sample preparation", 2011.
Van Reenen, Alexander et al "Integrated lab-on-chip biosensing systems based on magnetic particle actuation—a comprehensive review", The Royal Society of Chemistry, 2014.

* cited by examiner

DISPERSION AND ACCUMULATION OF MAGNETIC PARTICLES IN A MICROFLUIDIC SYSTEM

CROSS-REFERENCE TO PRIOR APPLICATIONS

This application is the U.S. National Phase application under 35 U.S.C. § 371 of International Application No. PCT/EP2015/078118, filed on Dec. 1, 2015, which claims the benefit of U.S. Provisional Patent Application No. 62/102757, filed on Jan. 13, 2015 and European Patent Application No. 14195888.4, filed on Dec. 2, 2014. These applications are hereby incorporated by reference herein.

This invention was made with US Government support under HR0011-12-C-0007 awarded by the Defense Advanced Research Projects Agency. The US Government has certain rights in this invention.

FIELD OF THE INVENTION

The invention relates to a microfluidic system for processing fluids containing magnetic particles. Moreover, it relates to methods for achieving dispersion and accumulation, respectively, of an ensemble of magnetic particles in such a microfluidic system.

BACKGROUND OF THE INVENTION

The WO 2010/070461 A1 discloses a microfluidic device comprising a magneto-capillary valve for liquids having an appreciable surface tension comprising magnetic particles. The device comprises at least two planar solid substrates with a functionalized surface each, wherein at least a first solid substrate has a patterned surface comprising at least two hydrophilic areas separated from one another by at least one hydrophobic area (cf. also Remco C. den Dulk, Kristiane A. Schmidt, Gwénola Sabatté, Susana Liébana, Menno W. J. Prins: "Magneto-capillary valve for integrated purification and enrichment of nucleic acids and proteins", Lab Chip, 2013, 13, 106).

SUMMARY OF THE INVENTION

In view of this background, it was an objective of the present invention to provide means that allow for a versatile handling of magnetic particles in a system comprising a magneto-capillary valve while at the same time enabling a compact design of the system.

According to a first aspect, an embodiment of the invention relates to a microfluidic system for processing fluids that contain magnetic particles, the system comprising the following components:

a) At least two chambers arranged to include a first fluid.

b) At least one channel communicating with said two chambers and arranged to comprise a second fluid, wherein a non-zero surface tension is created at the two fluidic interfaces between the first fluids and the second fluid.

c) A magnetic source with the following features:

The magnetic source is arranged to provide at least two separate magnetic gradient regions to attract into these regions magnetic particles present in the fluid of (at least) one of said chambers.

At least a portion of one of those gradient regions can apply a magnetic attraction force on at least a part of said magnetic particles which is sufficiently high to allow for pushing and/or pulling said magnetic particles through said two fluidic interfaces.

The term "magnetic particles" shall comprise both permanently magnetic particles as well as magnetizable particles, for example superparamagnetic beads. The size of the magnetic particles typically ranges between 3 nm and 50 μm. Moreover, the magnetic particles may comprise bound target components one is interested in.

The at least two chambers and the associated channel are typically realized in a one-piece microfluidic device (or cartridge), wherein the magnetic source is a component separate from said device. The chambers and the channel may in general have an arbitrary shape. Usually the chambers will have a compact shape allowing for the accommodation of a quantity of fluid, for example a cuboid shape. The volume of the chambers typically ranges between about 1 microliter and about 1000 microliter. The channel will usually have an elongated shape with a volume that is (much) smaller than that of the associated chambers. The channel typically connects the two chambers along a straight line.

The chambers and the channel may have a functionalized surface each such that hydrophilic areas in the chambers are separated from one another by a hydrophobic area of the channel (or vice versa). More details about such an embodiment may be found in the WO 2010/070461 A1.

The first fluids in the two chambers and the second fluid in the channel may be of the same kind, or some or all of them may be of different kind. Each of the first fluids creates one of the fluidic interfaces (meniscus) towards the second fluid that is accommodated in the channel. Accordingly, said interfaces are usually located in regions where a chamber is connected to the channel. The creation of a non-zero surface tension between a first fluid and the second fluid can for example be achieved when the first fluid is immiscible with the second fluid. More details about such an embodiment may be found in the WO 2011/042828 A1.

The "magnetic gradient regions" are determined by the magnetic properties of the magnetic source, i.e. their localization is usually fixed relative to said source. When the source is positioned adjacent to a chamber or the channel, at least a part of said magnetic gradient regions will reach into said chamber or channel, causing the generation of magnetic attraction forces on magnetic particles located therein.

In general, every magnet generates a magnetic field in the surrounding space for which the associated magnetic gradient assumes a maximum at some location. "Gradient regions" can in this context be defined as those regions of space in which the value of the magnetic gradient ranges above about 70%, preferably above about 80% of said maximum. In many practical applications of microfluidic systems, "gradient regions" may be defined as those regions of space in which the value of the magnetic gradient is larger than about 800 T/m, or about 500 T/m, or about 300 T/m, or about 200 T/m, or most preferably about 100 T/m.

The magnetic particles comprised by one of the first fluids will typically be prevented from entering the second fluid due to the non-zero surface tension, i.e. due to capillary forces, at the fluidic interface between said first fluid and the second fluid. When magnetic particles shall pass from a first fluid into the second fluid (or vice versa), this therefore usually requires that some resistance at the associated fluidic interface is overcome. In the described microfluidic system, at least a portion of one of the gradient regions is arranged to allow for the generation of a magnetic attraction force which is high enough to overcome said resistance. Pulling of magnetic particles through a fluidic interface typically requires that the respective gradient region is located ahead, i.e. on the other side of the interface, and that the magnetic particles are attracted through the interface towards this region.

The microfluidic system described above has the advantage to allow for a compact design as it uses only a single magnetic source. At the same time, versatile handling of magnetic particles becomes possible as said particles can be mixed with a first fluid in a chamber by attracting them to different gradient regions, and as magnetic particles can (with the same magnetic source) be moved through a magneto-capillary valve constituted by the channel between the at least two chambers.

In the following, various preferred embodiments of the invention will be described in more detail.

According to a first preferred embodiment, the magnetic source may be a permanent magnet. A permanent magnet has the advantage to allow for a miniaturization of components.

According to a preferred embodiment of the aforementioned permanent magnet, this may have a hexahedral shape, particularly a cubic shape or a parallelepiped shape. These shapes can readily be produced and provide for a plurality of separate gradient regions.

In another embodiment, the magnetic source may be an electromagnet. Electromagnets allow for a versatile and flexible control of their magnetic behavior by a respective control of their electric power supply.

According to another embodiment, the magnetic source may be arranged such that the relative position of the gradient regions with respect to a chamber containing the magnetic particles can be changed. This allows for a movement of magnetic particles within or through said chamber. Such a movement can for example be exploited for washing purposes, i.e. for transferring impurities from the magnetic particles into the surrounding fluid. Moreover, a movement can be used for manipulating magnetic particles according to the requirements of some processing assay.

In case the magnetic source is an electromagnet, the aforementioned change of position of gradient regions with respect to a chamber may be achieved by varying electrical currents through different coils or lines in the magnet. Alternatively and particularly in case of a magnetic source that is a permanent magnet, the magnetic source may be arranged to be movable with respect to the chambers and/or the channel. By moving the whole magnetic source, the aforementioned changes of the positions of the gradient regions can be achieved. Preferably, the magnetic source is movable within a two-dimensional plane that is adjacent to a plane comprising the chambers and the channel.

The kinds of fluids with which the chambers and the channel are filled depend on the particular processes that shall be executed with the microfluidic system. One of the first fluids may for example be an aqueous liquid originating from a sample such as a body fluid from which target substances shall be extracted with the help of magnetic particles. Moreover, at least one of the first fluids may be a solvent or buffer into which magnetic particles (comprising bound target substances) shall be transferred, leaving impurities behind in the sample fluid. In general, the first fluids may preferably be hydrophilic while the associated second fluid is hydrophobic. In another embodiment, there may be an opposite situation with the first fluids being hydrophobic and the second fluid being hydrophilic.

According to a second aspect, the invention relates to a method for achieving dispersion of an ensemble of magnetic particles in a chamber of a microfluidic system of the kind described above, said method comprising the positioning of the magnetic source adjacent to said chamber such that different parts of the ensemble will be subjected to magnetic attraction forces generated by at least two gradient regions, thereby effectuating a splitting of the ensemble.

The mentioned "ensemble" (or cloud, cluster) of magnetic particles typically forms spontaneously when magnetic particles in solution are not subjected to external magnetic forces but can follow their mutual magnetic attraction.

The presence of several magnetic gradient regions can then be exploited for dispersing an ensemble of magnetic particles, i.e. for mixing said magnetic particles with the surrounding fluid. This can simply be achieved by positioning the magnetic source appropriately, i.e. such that the ensemble is torn apart under the influence of at least two different gradient regions. Optionally the ensemble of magnetic particles may be subjected to the influence of more than two gradient regions, allowing for an associated further splitting of the ensemble into several parts.

According to a preferred embodiment of the above method, the ensemble of magnetic particles may be located on at least one connecting line between two gradient regions. The magnetic particles of the ensemble are then torn in opposite directions, wherein each particle will finally move to the gradient region it is attracted to with the largest force.

In a preferred embodiment, the magnetic source may be moved during the process of dispersion. Such a movement may assist the process of splitting the ensemble. Furthermore, the particles may be moved through the surrounding fluid, thus achieving a washing process. Movement may preferably take place in a back and forth manner. Moreover, movement of the magnetic source is preferably possible with different, selectable velocities because the effect on the magnetic particles depends both on the trajectory and the velocity of the relative motion between magnetic source and particles. Both have to be appropriately selected for a given cartridge geometry and choice of materials. For example, at very high velocities, the friction of the ensemble with its substrate may be dominant such that the particles do not move at all and no dispersal/collection is achieved. This effect can for example be used to deliberately leave behind an ensemble of particles.

A dispersion process that is comparatively fast and allows for the splitting of an ensemble into parts of similar size may be achieved by a proper dimensioning of the involved components. In particular, the distance between the at least two gradient regions that generate the magnetic attraction forces in the ensemble may correspond from about one to about five times the diameter of the ensemble. The two gradient regions will typically border on each other or partially overlap within the ensemble.

According to a third aspect, the invention relates to a method for accumulating an ensemble of magnetic particles in a chamber of a microfluidic system of the kind described above, said method comprising the positioning of a magnetic source adjacent to said chamber such that (preferably all) magnetic particles of the ensemble are subjected to magnetic attraction forces generated by only one gradient region.

The described method allows for the manipulation of all magnetic particles comprised by a chamber as a single ensemble, for example in case said magnetic particles shall be transferred to another location. This accumulation of magnetic particles in a single ensemble is achieved by exposing them to the influence of a single magnetic gradient region only. The magnetic source may for example be positioned adjacent to the chamber such that substantially only one gradient region overlaps with said chamber while the other gradient regions are located outside the chamber.

In a preferred embodiment of the method, the magnetic source may be moved, allowing for an associated transportation of the ensemble of magnetic particles through the chamber. For the reasons already explained above, movement of the magnetic source may preferably possible with different, selectable velocities.

BRIEF DESCRIPTION OF THE DRAWINGS

These and other aspects of the invention will be apparent from and elucidated with reference to the embodiments described hereinafter.

In the drawings.

Like reference numbers refer in the Figures to identical or similar components.

DETAILED DESCRIPTION OF EMBODIMENTS

A microfluidic device with a magneto-capillary valve (MCV) for liquids has been disclosed in the WO 2010/070461 A1. During sample preparation using such a MCV technology, magnetic particles interact with an external magnetic field and are thereby displaced through several stationary and separate volumes of different buffer solutions. In this process, the particles are washed as the original sample matrix is progressively diluted by the washing buffers.

The MCV requires transportation of magnetic particles (from buffer to buffer) as well as mixing (in a new buffer), and both functions need a different magnetic configuration. This can be achieved by an MCV instrument including two magnets, a transport magnet and a washing magnet, which must be separated by a distance of several centimeters to avoid cross-talk. The necessity to provide two magnets limits however the possibility to miniaturize the MCV instrument.

To address the aforementioned needs, it is proposed here to design a single magnet that can do both transportation and washing. In particular, an embodiment of a microfluidic system for processing fluids may comprise:

- A microfluidic device comprising at least two chambers arranged to include (first) fluids, and at least one channel communicating with the two chambers and arranged to comprise another (second) fluid, the microfluidic device being further arranged such that a non-zero surface tension is created at the two fluidic interfaces (i.e. meniscus) between said fluids. Due to the surface tension conditions, the aforementioned channel is an MCV between the two chambers.
- A magnetic source arranged to provide at least two separate magnetic gradient regions to attract into these regions some magnetic particles present in the fluid of one chamber, wherein at least a portion of one of those regions applies a magnetic attraction force on at least part of said particles sufficiently high to overcome the resistance of the fluidic interfaces between the chambers and the channel in case the particles are magnetically pushed on or pulled out this interface. The effect of the aforementioned pushing or pulling is to drive the particles through the MCV. Preferably the ensemble of particles may be located between two gradient regions such that at least two particles are drawn to different attraction zones. Optionally, the magnetic source may further be arranged such that the relative position of the gradient regions with respect to the chamber can be changed, allowing for the mixing of magnetic particles.

Figure 1:
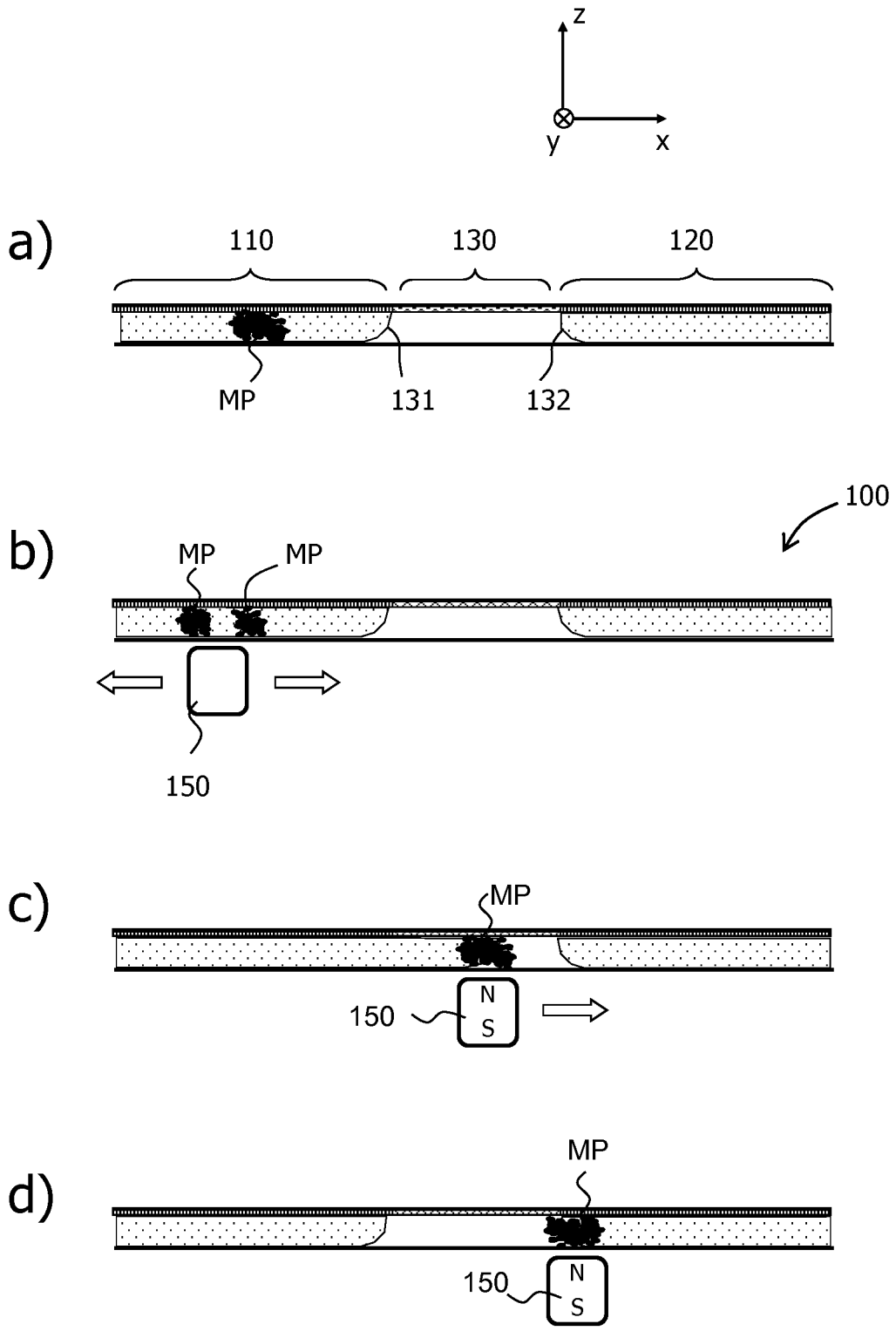
FIG. 1 shows a side view of a microfluidic system according to an embodiment of the present invention during the stages of dispersion and transportation of an ensemble of magnetic particles.

FIG. 1 schematically illustrates a microfluidic system 100 according to an embodiment of the above principles in four different stages of its usage.

In FIG. 1*a*, the microfluidic device of the microfluidic system 100 is shown. A first fluid (e.g. a biological sample) with magnetic particles MP is comprised by a first chamber 110, another (first) fluid (e.g. a buffer) is comprised by a second chamber 120, and a channel 130 connecting the first chamber 110 to the second chamber 120 is filled with a second fluid that is immiscible with the first fluids in the first and second chambers, respectively. The second fluid may for example be air or some other gas. Two fluidic interfaces 131 and 132 are constituted between the first fluids and the second fluid at which there is a non-zero surface tension. Moreover, at least a part of the walls of the chambers 110, 120 and the channel 130 may have differently functionalized surfaces, particularly hydrophilic surfaces in the chambers and a hydrophobic surface in the channel, as an optional refinement of the microfluidic configuration.

Magnetic particles MP are comprised by the first fluid in the first chamber 110. They tend to form an ensemble (or cloud, cluster) due to mutual magnetic attraction forces.

In FIG. 1*b*, the microfluidic system 100 is completed by a magnetic source 150 which subjects the magnetic particles MP to magnetic forces.

Figure 2:
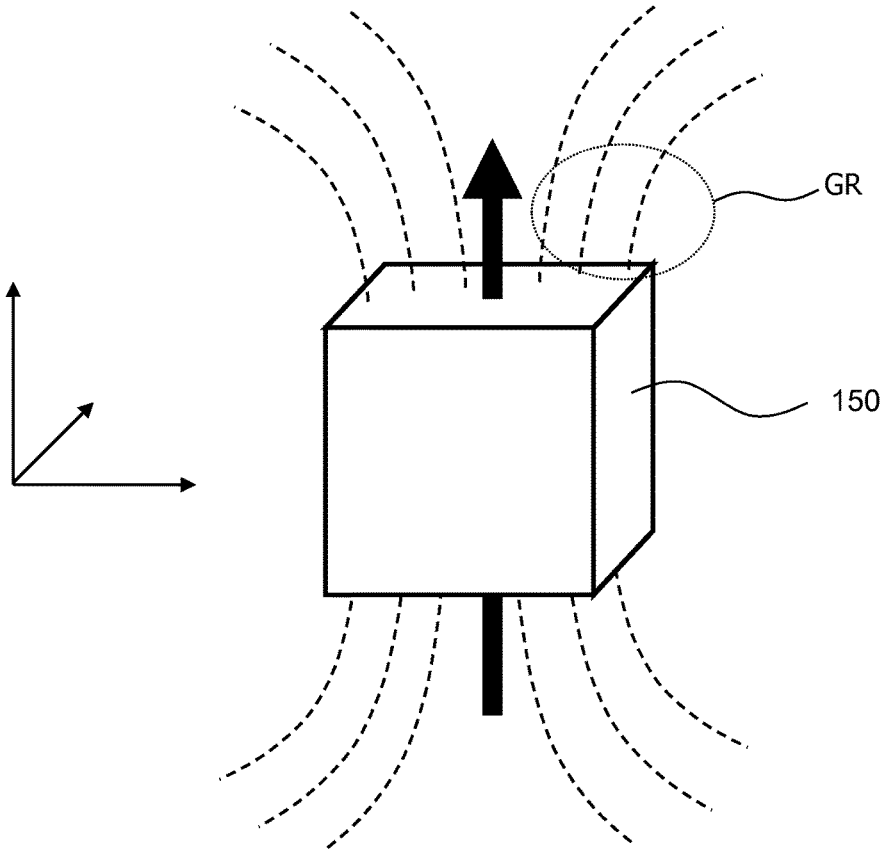
FIG. 2 is a three-dimensional illustration of a magnetic source of the system of FIG. 1.

A possible embodiment of the magnetic source 150 is illustrated in FIG. 2. This source 150 is a permanent magnet of cubic shape exhibiting a magnetic north pole N at its top side and a magnetic south pole S at its bottom side. Due to the cubic shape, four gradient regions GR are formed at the four corners of the magnetic source 150 where magnetic gradients are particularly high. One such gradient region GR is schematically indicated in the drawing by dotted lines. The gradient regions GR extend from the surface of the magnetic source 150 somewhat into the adjacent space. The magnetic gradients within these regions substantially lie within the xy-plane of the associated coordinate system. Hence forces exerted on magnetic particles within and by the gradient regions GR will lie in this plane, too, and substantially point towards the corners of the magnetic source 150.

Returning to FIG. 1*b*, it can be seen that the ensemble of magnetic particles MP is simultaneously subjected to the influence of several gradient regions GR (two can be seen in the Figure). The ensemble of magnetic particles MP is therefore split into several parts which collect within the respective gradient regions. As indicated by arrows, the magnetic source 150 may additionally be moved with respect to the first chamber 110 to assist the effect of splitting and to achieve a washing effect by moving the magnetic particles through the surrounding fluid.

Accordingly, the microfluidic system 100 provides for a method to achieve dispersion of an ensemble of accumulated magnetic particles by positioning the magnetic source adjacent to the microfluidic device at some given velocity such that, when projected into the plane of the microfluidic device, the ensemble of particles is located on at least one connecting line between at least two of the magnetic field gradient regions such that the field of magnetic forces exerted on different parts of the ensemble of particles exhibits at least two attraction zones, thereby effectuating a splitting of the particle ensemble.

In FIGS. 1*c* and 1*d*, the transfer of the ensemble of magnetic particles MP through the magneto-capillary valve formed by the channel 130 is illustrated. In this procedure all magnetic particles MP of the sample in the first chamber 110 are attracted to one gradient region of the magnetic source 150. When the source 150 is moved to the right, the ensemble of magnetic particles MP is first pulled through the first interface 131, then moved within the channel 130, and finally pulled through the second interface 132 to be released into the fluid of the second chamber 120.

Accordingly, the microfluidic system 100 provides for a method to accumulate an ensemble of magnetic particles by positioning the magnetic source adjacent to the microfluidic device at some given velocity such that, when projected into the plane of the microfluidic device, the ensemble of particles is located such that the field of magnetic forces exerted on different parts of the ensemble of particles exhibits only one attraction zone, i.e. in the vicinity of one of the magnetic gradient regions.

The magnetic source 150 can thus be used for both particle transport and mixing which allows for a reduction of the size and speed requirements of the magnetic actuator in the system 100.

The magnetic source 150 may be attached to an actuator that allows displacement of the magnet in two dimensions (x and y in the Figures) while keeping a constant distance to the bottom side of the MCV microfluidic device. By using only one magnet to both transport and mix the particles inside the cartridge, the travel range of the actuator does not have to be larger than the maximum extents of the relevant fluidic structures of the cartridge.

In general, the magnetic source 150 may be an electromagnet and/or a permanent magnet. In a particular embodiment, the magnetic source 150 may be realized as a single permanent magnet with a hexahedral shape. The shape may especially be cubic (as shown in FIG. 2) or parallelepiped. The magnetic field of such a magnet exhibits the strongest gradients at the four corners (tips) of a face that comprises a pole of the magnet (i.e there are four magnetic gradient regions in this particular embodiment). When displacing the magnet, the particle ensemble will be drawn towards one of the tips.

Figure 3:
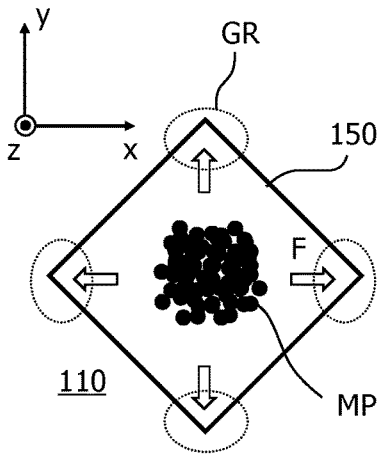
FIG. 3 illustrates a top view onto the magnetic source at the beginning of the dispersion of an ensemble of magnetic particles by four gradient regions.

As is illustrated in FIG. 3 in a top view onto the magnetic source 150, the magnet 150 can be positioned such that the particle ensemble is surrounded by the tips of the magnet. The resulting magnetic forces will draw the particles towards different points and thereby cause splitting of the magnetic particle ensemble. Hence mixing may be achieved when an ensemble of magnetic particles MP is located above the center of the top face of the magnet. If the projected area of the particle ensemble is not substantially larger than the top face of the magnet, the magnetic particle cloud will experience approximately equal forces F originating from the four corners of the magnet 150. Provided that the cohesive forces between the particles, e.g. by entanglement with long macromolecules, are not larger than the applied magnetic forces, the particle ensemble will be dispersed. Importantly, the dispersal of particles does not require rapid movements of the magnet.

Figure 4:
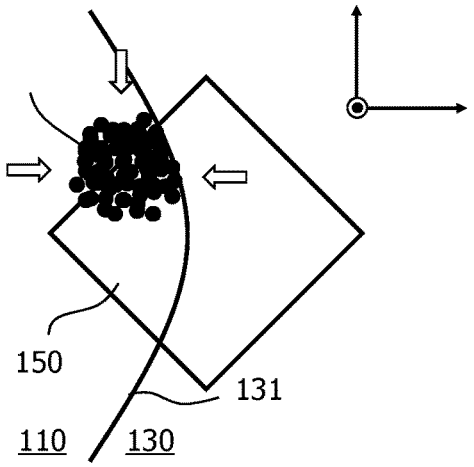
FIG. 4 illustrates a top view onto the magnetic source during the transportation of an ensemble of magnetic particles through a fluidic interface.

As is illustrated in FIG. 4 in another top view onto the magnetic source 150, magnetic particle transport is achieved by concentrating particles MP above any of the four upper corners of the magnet 150. When transporting the magnetic particle ensemble through a fluid meniscus (e.g. 131 or 132), the resulting force exerted by the fluid meniscus and the magnet will draw the particles MP towards the trailing tip of the magnet. If for example the diagonal of the upper face of the magnet is aligned with the main transport direction of the MCV cartridge (i.e. the long axis of the cartridge, corresponding to the x-axis in the Figure) the magnetic particles MP will be drawn towards the rearmost corner of the magnet (left corner in the Figure) during transport between chambers. This effect can be explained by the balance between the capillary force at the fluid meniscus 131 and the magnetic gradient force.

EXAMPLE

To prove the effectiveness of a single cubic magnet 150 in achieving equal or better transport and mixing performance, the inventor has determined the extraction yield of radioactively labelled RNA, i.e. the percentage of input RNA that could be transported through the microfluidic channel 130 and made available for downstream processing. In order to establish this evidence, the inventor compared a single cubic magnetic source 150 according to the invention with a magnetic system comprising the cylindrical magnet as disclosed in FIG. 5 of WO 2010/070461: the edge of the cubic magnetic source 150 was of 5 mm and the diameter of the cylindrical magnet was of 4 mm for 10 mm long, both applied on the same magnetic particles (i.e. having the same properties and the same number) to transport them from a chamber 110 to a chamber 120 via the channel 130, chambers 110 and 120 having 220 micrometers height and a volume of about 20 microliters each, and a channel 130 of about 5 mm width. Further to the cylindrical magnet, and in order to find an equivalent extraction yield as the one found with the single cubic magnetic source 150, the inventor had to further add in said magnetic system an array of magnets having polarities successively opposed one to the other arranged to mix the magnetic particles in chamber 110 and/or chamber 120 by moving this magnetic array above the chamber(s).

Using an actuation protocol of the same length and the same sample matrix, the inventor has therefore shown that the compact square magnet system 150 can perform equally well as said dual-magnet assembly. In particular, the function of transportation of the cylindrical magnet and the function of mixing of the magnetic array are both exerted by the single cubic magnetic source 150, and with the same efficiency, although the magnetic source 150 of the invention is a single magnetic element, and so clearly more simple and less cumbersome than the dual-magnet assembly.

Furthermore, the integration of said dual-magnet assembly would lead to separate said cylindrical magnet from said magnetic array by a gap sufficiently large to prevent the cross-talk between the two types of magnets. Typically this would lead to separate the cylindrical magnet from the magnetic array by about 30 mm, which increases considerably the size of this magnetic assembly.

As already indicated, the usage of a single (e.g. cubic, permanent) magnet to operate an MCV leads to a further miniaturization of the surrounding instrument or sub-assembly of an instrument, which is essential for integration with detection technologies and for operation in compact instruments. Furthermore, the velocity requirements for the magnet actuator can be reduced which enables the use of low-cost actuators, e.g. such as the ones found in standard CD drives.

In summary, an approach has been disclosed in which the shape of a magnet is used as an actuator in particle-based sample preparation for in-vitro diagnostics. By choosing a magnet with multiple tips and a size comparable to the particle ensemble to be actuated, one magnet can be used for both particle transport and mixing which reduces the size and speed requirements of the magnetic actuator. A microfluidic system according to an embodiment of the invention includes a magnetic source with (i) at least one tip (i.e. a region of increased magnetic field gradient that attracts magnetic particles in three dimensions) with bulk dimensions and tip sharpness sufficient to effectuate transport of an ensemble of magnetic particles, and (ii) more than one tip preferably spaced between one and five times the diameter of the particle ensemble such as to generate magnetic forces that draw particles inside the particle clouds towards different tips.

Embodiments of the invention can for example be used as part of the magnet actuator assembly of a MCV sample preparation system.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A microfluidic system comprising:

a first chamber configured to hold a first fluid, a magnetic particle ensemble being disposed in the first fluid in the first chamber;

a second chamber configured to hold a second fluid;

a channel fluidically connecting the first and second chambers and configured to hold a third fluid, wherein a non zero surface tension is created at fluidic interfaces between the third fluid and the first fluid and between the third fluid and the second fluid;

a magnetic source with at least two tips provides at least two separate magnetic gradient regions, each of the at least two separate magnetic gradient regions being configured to attract magnetic particles of the magnetic particle ensemble;

wherein the magnetic source is positionable to attract parts of the magnetic particle ensemble towards the at least two separate gradient regions splitting the magnetic particle ensemble and provides a sufficiently high magnetic force to allow for pushing and/or pulling the magnetic particles through said fluidic interfaces.

2. The microfluidic system according to claim 1, wherein the magnetic source is a permanent magnet.

3. The microfluidic system according to claim 2, wherein the permanent magnet has a hexahedral shape and corners of the hexahedral shape permanent magnet define the tips.

4. The microfluidic system according to claim 1, wherein the magnetic source is an electromagnet.

5. The microfluidic system according to claim 1, wherein the magnetic source is configured to change a relative position of the at least two gradient regions with respect to the first chamber containing the magnetic particles.

6. The microfluidic system according to claim 1, wherein the magnetic source is movable with respect to the first chamber, the second chamber and/or the channel.

7. The microfluidic system according to claim 1, wherein the first and second fluids are hydrophilic and the third fluid is hydrophobic, or vice versa.

8. A method to achieve dispersion of an ensemble of magnetic particles in a chamber of the microfluidic system according to claim 1, the method comprising:

positioning of the magnetic source adjacent to said first chamber such that different parts of the magnetic particle ensemble are attracted to each of the at least two gradient regions, thereby effectuating a splitting of the magnetic particles of the magnetic particle ensemble.

9. The method according to claim 8, wherein the at least two gradient regions include a first gradient region and a second gradient region; and wherein the magnetic source and the magnetic particle ensemble are positioned such that the magnetic particle ensemble is disposed on a connecting line between the first and second gradient regions.

10. The method according to claim 8, wherein the at least two gradient regions include a first gradient region and a second gradient region and a distance between the first and second gradient regions corresponds to about one to about five times a diameter of the magnetic particle ensemble.

11. The method according to claim 8, further including:

after splitting the magnetic particle ensemble, moving the magnetic source to disperse the magnetic particles in the first fluid.

12. The method system according to claim 8, further including:

positioning of the magnetic source adjacent to said first chamber such that all magnetic particles are attracted back into a single magnetic particle ensemble.

13. The method according to claim 12, further including:

moving the magnetic source to position the magnetic particle ensemble adjacent one of the gradient regions; and moving the magnetic source to pull or push the magnetic particle ensemble through the fluidic interfaces with said one of the gradient regions.

* * * * *